US009564740B2

(12) United States Patent
Niessner et al.

(10) Patent No.: US 9,564,740 B2
(45) Date of Patent: Feb. 7, 2017

(54) SPARK PLUG FOR A GAS-POWERED INTERNAL COMBUSTION ENGINE

(71) Applicant: Federal-Mogul Ignition GmbH, Neuhaus-Schierschnitz (DE)

(72) Inventors: Werner Niessner, Steinheim (DE); Rene Trebbels, Huckelhoven (DE)

(73) Assignee: FEDERAL-MOGUL IGNITION GmbH, Neuhaus-Schierschnitz (DE)

( * ) Notice: Subject to any disclaimer, the term of this patent is extended or adjusted under 35 U.S.C. 154(b) by 0 days.

(21) Appl. No.: 14/956,762

(22) Filed: Dec. 2, 2015

(65) Prior Publication Data

US 2016/0156159 A1 Jun. 2, 2016

(30) Foreign Application Priority Data

Dec. 2, 2014 (DE) ..... 10 2014 117 714

(51) Int. Cl.
*H01T 13/54* (2006.01)
*H01T 13/32* (2006.01)
*H01T 13/16* (2006.01)

(52) U.S. Cl.
CPC ..... *H01T 13/32* (2013.01); *H01T 13/16* (2013.01); *H01T 13/54* (2013.01)

(58) Field of Classification Search
CPC ..... H01T 13/32; H01T 13/54; H01T 13/16
See application file for complete search history.

(56) References Cited

U.S. PATENT DOCUMENTS 1,538,750 A * 5/1925 Scognamillo ..... H01T 13/467 123/169 TC
1,542,631 A * 6/1925 Morrison ..... H01T 13/54 220/288
3,958,144 A * 5/1976 Franks ..... H01T 13/14 313/118

(Continued)

FOREIGN PATENT DOCUMENTS

CA 2826807 A1 8/2012
CN 202840241 U 3/2013

(Continued)

OTHER PUBLICATIONS

German Office Action dated Sep. 21, 2015, 8 pages.

*Primary Examiner* — Anne Hines
*Assistant Examiner* — Jose M Diaz
(74) *Attorney, Agent, or Firm* — Reising Ethington, P.C.

(57) ABSTRACT

A spark plug for a gas-powered internal combustion engine having: a spark plug body; an insulator; a center electrode; a ground electrode support that is attached to the spark plug body and supports at least one ground electrode that forms a spark gap with the center electrode; a swirl chamber located at the front end of the spark plug whose wall surrounds the center and ground electrodes; the wall of the swirl chamber is formed by a cylindrical sleeve which has an open front face and radial perforations; the ground electrode support includes an annular base part and at least one arm that supports the ground electrode; the arm starts at the base part and extends within the swirl chamber. The arm of the ground electrode support increases in cross-section starting from the ground electrode it supports toward the annular base part of the ground electrode support.

13 Claims, 2 Drawing Sheets

(56) References Cited

U.S. PATENT DOCUMENTS

| | | | | |
|---|---|---|---|---|
| 4,766,861 | A * | 8/1988 | Finsterwalder | H01T 13/54 123/143 B |
| 4,930,473 | A * | 6/1990 | Dietrich | H01T 13/54 123/169 EL |
| 5,623,179 | A * | 4/1997 | Buhl | H01T 13/467 313/141 |
| 5,734,222 | A | 3/1998 | Callaghan | |
| 5,799,637 | A * | 9/1998 | Cifuni | H01T 13/54 123/169 PA |
| 5,892,319 | A * | 4/1999 | Rossi | H01T 13/467 313/118 |
| 6,064,144 | A | 5/2000 | Knoll | |
| 6,583,539 | B1 * | 6/2003 | Zamora | H01T 13/467 313/141 |
| 6,628,049 | B2 * | 9/2003 | Rosenthal | H01T 13/467 313/141 |
| 7,615,914 | B2 | 11/2009 | Francesconi | |
| 8,143,772 | B2 | 3/2012 | Francesconi | |
| 8,657,641 | B2 | 2/2014 | Burke | |
| 8,853,926 | B2 * | 10/2014 | Morin | H01T 13/39 313/141 |
| 2002/0180326 | A1 * | 12/2002 | Francesconi | H01T 13/54 313/140 |
| 2006/0181185 | A1 * | 8/2006 | Yamanaka | H01T 13/32 313/144 |
| 2007/0236122 | A1 | 10/2007 | Borror | |
| 2009/0133667 | A1 * | 5/2009 | Inoue | F02B 19/12 123/260 |
| 2011/0089803 | A1 * | 4/2011 | Francesconi | H01T 13/54 313/11.5 |
| 2011/0148274 | A1 * | 6/2011 | Ernst | H01T 13/467 313/141 |
| 2012/0125279 | A1 * | 5/2012 | Hampson | H01T 13/54 123/169 R |
| 2012/0242215 | A1 * | 9/2012 | Hwang | H01T 13/54 313/143 |
| 2013/0313960 | A1 * | 11/2013 | Francesconi | H01T 13/467 313/140 |
| 2015/0028737 | A1 | 1/2015 | Alfonso | |
| 2015/0040845 | A1 * | 2/2015 | Chiera | F02B 19/108 123/41.32 |

FOREIGN PATENT DOCUMENTS

| | | | |
|---|---|---|---|
| DE | 19705372 | A1 | 8/1998 |
| DE | 102012018625 | A1 | 4/2014 |
| EP | 1265329 | A1 | 12/2002 |
| EP | 2208268 | A1 | 7/2010 |
| FR | 2786036 | A1 | 5/2000 |
| WO | WO2009059339 | A1 | 5/2009 |
| WO | WO2009059340 | A1 | 5/2009 |
| WO | WO2012113002 | A1 | 8/2012 |
| WO | WO2012159756 | A1 | 11/2012 |
| WO | WO2014094988 | A1 | 6/2014 |

* cited by examiner

SPARK PLUG FOR A GAS-POWERED INTERNAL COMBUSTION ENGINE

This application claims the benefit of German Application No. 10 2014 117 714.2, filed on Dec. 2, 2014, the contents of which are hereby incorporated by reference in their entirety.

FIELD

The invention concerns a spark plug for a gas-powered internal combustion engine.

BACKGROUND

In contrast to spark plugs with swirl chambers, in which the ground electrodes or ground electrode supports are arranged on the wall of the swirl chamber so that the current flowing during ignition is dissipated by the ground electrode through the wall of the swirl chamber to the spark plug body, such as are known from EP 1,265,329 A1, for example, the spark plugs of the present type have the advantage that the ground electrodes and their supports represent a system independent of the wall of the swirl chamber on account of the arms of the ground electrode support that extend within the swirl chamber. This ensures a defined and uniform carrying of current through the ground electrode support without any dissipation of current through the wall of the swirl chamber. Moreover, simple adjustment of the ground electrodes is made possible so that a spark gap that has changed due to electrode consumption resulting from use can be corrected. With regard to thermal considerations, the dissipation of heat from the ground electrodes through the arms of the ground electrode support, which are shielded from the wall of the swirl chamber, is better than when the ground electrodes are attached to the swirl chamber wall. These distinctions are addressed in EP 2,208,268 B1 and WO2012/113002 A1.

An object of the present invention is to further improve a spark plug of the type mentioned at the outset while preserving the stated advantages.

SUMMARY

According to one aspect, a spark plug is provided for a gasoline-powered internal combustion engine, in particular a stationary gasoline engine, and the spark plug has a spark plug body with a passage in which an insulator is located. The spark plug has a front end and a back end, wherein the insulator projects from the spark plug body at the back end and has a supply terminal there for connecting a supply line providing the ignition voltage. The spark plug includes a center electrode that projects from the insulator at the front end and is connected in an electrically conductive manner to the supply terminal through a center conductor located in the insulator. A ground electrode support attached to the spark plug body is provided that supports at least one ground electrode that forms a spark gap together with the center electrode. The ground electrode support holds at least two ground electrodes, each of which forms a spark gap together with the center electrode. In particular, two to four ground electrodes may be arranged around the center electrode. Located at the front end of the spark plug is a swirl chamber that has an open front face. The wall of the swirl chamber surrounds the center electrode and the ground electrodes. In particular, the wall projects beyond the electrodes at the front end. The wall of the swirl chamber is formed by a sleeve in the shape of a cylinder, in particular in the shape of a circular cylinder, which has radial perforations. The perforations form openings in the wall that pass through the wall in the radial direction and permit inflow of the gas/air mixture into the swirl chamber.

The ground electrode support includes an annular base part and at least one arm that supports the ground electrodes. In particular, the ground electrode support includes at least two arms. Each of the arms can support one of the ground electrodes. The spark plug can also include an annular ground electrode that is supported by at least two arms and, in particular, is welded to the arms. Each of the arms starts at the base part and extends within the swirl chamber in the longitudinal direction of the spark plug. Each of the arms of the ground electrode support increases in cross-section starting from the ground electrode it supports toward the annular base part of the ground electrode support. In particular, the cross-section of the arm can increase continuously here. Preferably, a gap can be present between each of the arms of the ground electrode support and the wall of the swirl chamber, with the gap becoming smaller in a direction running from the front end of the spark plug to the back end of the spark plug.

The spark plug described herein may have any combination of the following advantages:

- the proven system of current dissipation taking place separately from the swirl chamber is retained; the sleeve forming the wall of the swirl chamber can therefore also be made of electrically nonconductive material;
- because the cross-section of the arms of the ground electrode support increases toward the spark plug body, heat dissipation from the ground electrodes is greatly improved; the temperature of the ground electrodes can be reduced as a result; this leads to reduced wear, in particular reduced consumption at the ground electrode, and thus to an increased service life of the spark plug; especially good heat dissipation is achieved through a one-piece design of the arms and the annular base part of the ground electrode support; and
- the spacing between the electrodes can be adjusted easily, for example when the spark gap has increased due to electrode consumption arising in operation; to this end, the perforations in the sleeve that forms the wall of the swirl chamber, in particular, are positioned such that each of the arms of the ground electrode support is accessible in the radial direction through one of the perforations; in this way, the electrode spacing can be adjusted very easily from outside.

According to another aspect, the annular base part of the ground electrode support can have a flat base surface, and the spark plug body can have a flat face on the front end. The flat base surface of the ground electrode support rests against the face of the spark plug body. This permits a large contact area between the ground electrode support and the spark plug body, which further improves the heat dissipation from the ground electrodes. The ground electrode support can be welded to the spark plug body, in particular in the contact region of the face and base surface, and in particular by means of a continuous weld seam extending along the entire circumference. The flat face at the front end of the spark plug body simplifies the manufacture of the spark plug body, since steps or shoulders are no longer provided there.

The sleeve forming the wall of the swirl chamber can be made of metal or ceramic. The ground electrode support can support the sleeve forming the wall of the swirl chamber. A ceramic sleeve can be attached by active brazing or by flanging or crimping of a shoulder. A metal sleeve is preferably attached by welding.

The center electrode can have at its front end a precious metal ring that is made of a precious metal or a precious metal alloy, for example platinum or a platinum alloy, or iridium or an iridium alloy, in order to reduce consumption. The ground electrodes can likewise be made of a precious metal or a precious metal alloy, for example platinum or a platinum alloy, or iridium or an iridium alloy, or can be tipped therewith on their side facing the spark gap.

In the disclosed method for producing the spark plug provision can be made that the sleeve forming the wall of the swirl chamber is first attached to the ground electrode support, and this prefabricated assembly is then placed on the spark plug body and welded thereto. This approach has the advantage that it is easier to achieve concentricity of the sleeve, ground electrode support, and spark plug body, which is necessary for screwing the spark plug into the threads on the internal combustion engine. Alternatively, provision can also be made to weld the ground electrode support to the spark plug body first. This has the advantage that an adjustment of the electrode spacing can still be made very simply before the sleeve forming the wall of the swirl chamber is then set in place and attached.

According to another aspect, provision can be made for the ground electrode support to have an annular collar. The collar is arranged circumferentially on the ground electrode support, and is concentric to its annular base part. The ground electrode support can have an annular groove that is located between the collar and the arms. The groove can, in particular, be rounded at its base, which is to say that it can have a rounded groove bottom. The sleeve forming the wall of the swirl chamber can be attached to the collar of the ground electrode support, in particular by welding in the case of a metal sleeve. This embodiment has the advantage that the base part and collar of the ground electrode support ensure a stable attachment of the arms and the sleeve to the spark plug body that has low stress concentration and can withstand the vibrations and shock loads occurring on the internal combustion engine, even over very long periods of operation.

Additional advantages and features of the present spark plug are evident from the dependent claims and from the description below of an exemplary embodiment in conjunction with the figures.

DRAWINGS

Preferred exemplary embodiments of the invention will hereinafter be described in conjunction with the appended drawings, wherein like designations denote like elements, and wherein.

DESCRIPTION

Figure 1:
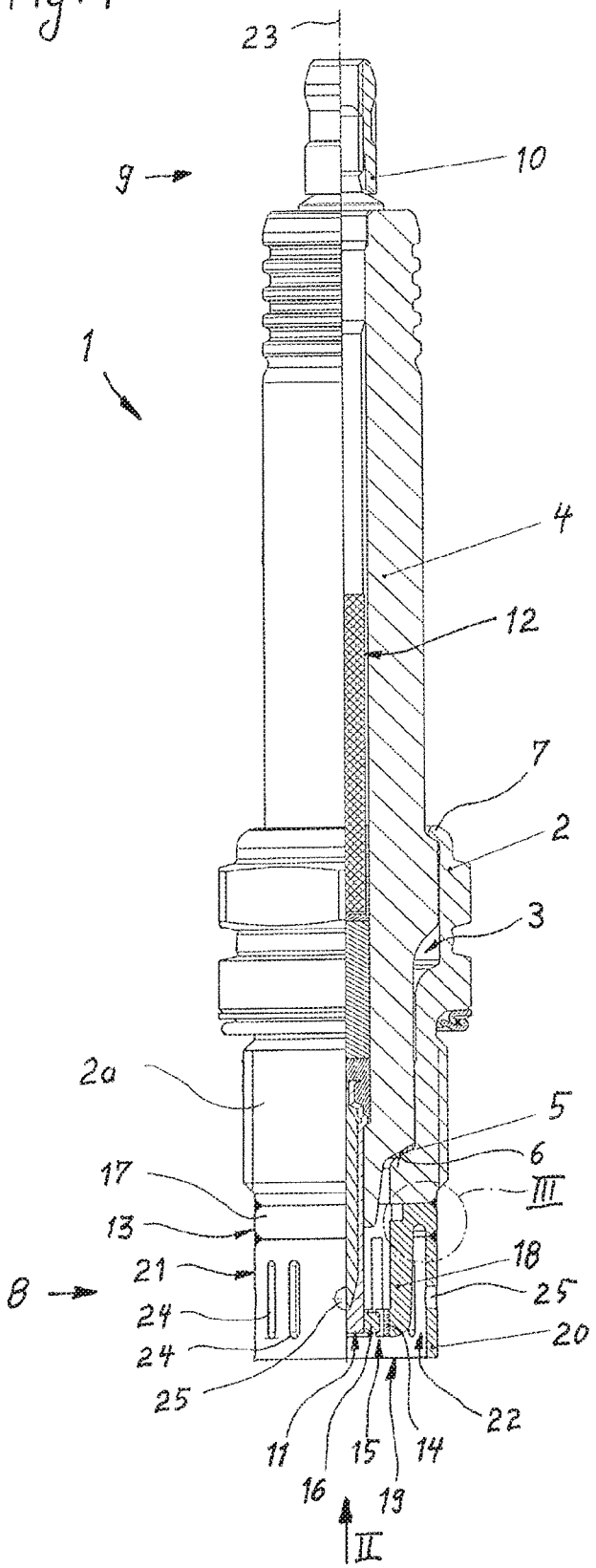
FIG. 1 is an embodiment of the present spark plug shown partially in longitudinal section.

The spark plug 1 shown in the figures includes a spark plug body 2 with a passage 3 in which an insulator 4 is located. The insulator 4 is secured in a known manner in the spark plug body 2 between a bearing surface 6 and a crimped shoulder 7 with the interposition of a seal 5. The spark plug 1 has a front end 8 and a back end 9, wherein the insulator 4 projects from the spark plug body 2 at the back end 9, and has there a supply terminal 10 for the electric current supplied by an ignition coil. At the front end 8, a center electrode 11 projects from the insulator 4 and is connected in an electrically conductive manner to the supply terminal 10 through a center conductor 12 located in the insulator 4.

Figure 2:
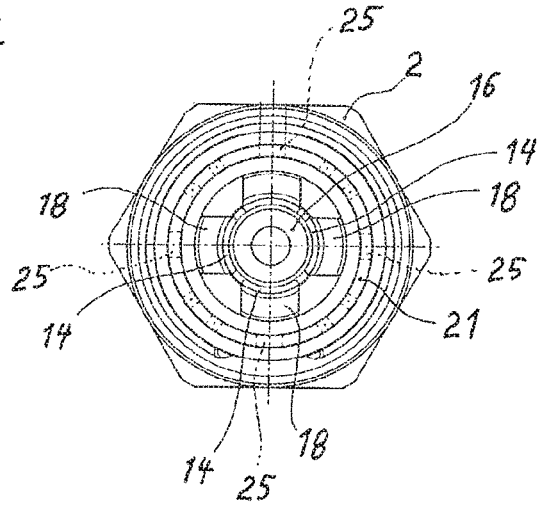
FIG. 2 is a view in the direction of the arrow II from FIG. 1 of the front end of the spark plug.

Connected to the spark plug body 2 is a ground electrode support 13, which supports, e.g., four ground electrodes 14, each of which forms a spark gap 15 with the center electrode 11. The center electrode 11 preferably includes at its front end 8 a precious metal ring 16 in order to reduce consumption due to the ignition spark in the spark gap 15. The ground electrodes 14 can likewise be made of a precious metal. The contour of the ground electrodes 14 is matched to the circular cylindrical external surface of the center electrode 11 or its precious metal ring 16, as is especially evident in FIG. 2. The ground electrode support 13 includes an annular base part 17 and four arms 18 that start at the base part 17 and each support, at their ends, one ground electrode 14. The base part 17 and arms 18 are produced as a single piece.

Located at the front end 8 of the spark plug 1 is a swirl chamber 19, which has an open front face and whose wall 20 is formed by a circular cylindrical sleeve 21. At the front end 8, the wall 20 projects beyond the center electrode 11 and the ground electrodes 14, and forms a shield. Each of the arms 18 extends within the swirl chamber 19 in the longitudinal direction of the spark plug 1. Present between each of the arms 18 and the wall 20 of the swirl chamber 19 is a gap that becomes smaller in a direction running from the front end 8 to the back end 9. The wall 20 is separated from the ground electrode support 13 or its arms 18 by the gap 22.

Each of the arms 18 increases in cross-section starting from the ground electrode 14 it supports toward the annular base part 17. This is achieved by the means that the inner side—when viewed in longitudinal section—of each arm 18 is parallel to the center line 23 of the spark plug 1, and the outer side of each arm 18 extends at an angle to the center line 23. The distance between the outer side of each arm 18 and the center line 23 increases in a direction running from the front end 8 to the back end 9.

The sleeve 21 forming the wall 20 of the swirl chamber 19 has radial perforations 24 and 25. The perforations 24 designed as slots and the perforations 25 designed as bores constitute radial inlet ports into the swirl chamber 19, through which the gas/air mixture can enter the swirl chamber 19 to be ignited there. The perforations 25 are arranged in the circumferential direction of the wall 20 such that one perforation 25 is associated with each of the arms 18; see FIG. 2 in particular. Each arm 18 is accessible in the radial direction through one of the perforations 25 for adjusting the electrode spacing at the spark gap 15. If wear of the ground electrode 14 or of the ring 16 has occurred after a certain period of operation, and the spark gap 15 has become too large, the arm 18 can be bent inward a bit toward the center line 23 in the radial direction through the perforation 25 so that the spark gap 15 again has the specified dimension desired.

Figure 3:
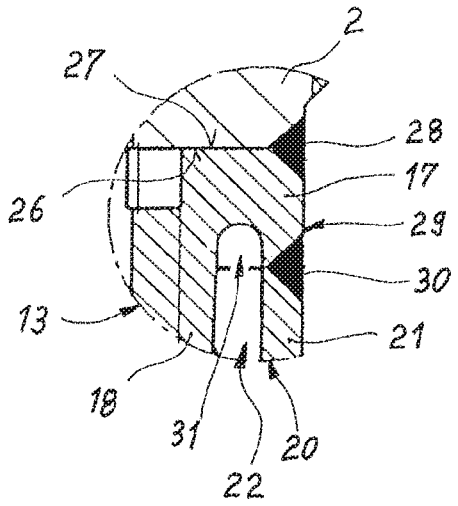
FIG. 3 an enlarged view of the area indicated in FIG. 1 by the dot-and-dash circle III.

At the front end 8, the spark plug body 2 has a thread 2*a* for screwing the spark plug into the internal combustion engine, and a flat front face 26, which a flat base surface 27 of the annular base part 17 rests against. The ground electrode support 13 is welded to the spark plug body 2 in the region of the surfaces 26, 27 by means of a continuous weld seam 28 extending along the circumference of the spark plug body 2. The ground electrode support 13 holds the sleeve 21 that forms the wall 20 of the swirl chamber 19. To this end, the ground electrode support 13 has an annular collar 29 that is concentric to the annular base part 17 and is arranged circumferentially. The sleeve 21 is made of metal and is seated on the collar 29. The sleeve 21 is attached to the collar 29 by a continuous weld seam 30 extending along the collar 29. Between the collar 29 and the arms 18, the ground electrode support 13 includes an annular groove 31, which is rounded at its base; see FIG. 3 in particular. The annular groove 31 constitutes a defined end region of the gap 22 between the wall 20 and the arms 18 so that an attachment that is stable and has low stress concentration is ensured between the arms 18, the sleeve 21 and the base part 17 of the ground electrode support 13.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMBERS

1 spark plug
2 spark plug body
2*a* thread
3 passage
4 insulator
5 seal
6 bearing surface
7 shoulder
8 front end
9 back end
10 supply terminal
11 center electrode
12 center conductor
13 ground electrode support
14 ground electrodes
15 spark gap
16 precious metal ring
17 base part
18 arms
19 swirl chamber
20 wall
21 sleeve
22 gap
23 center line
24 perforations
25 perforations
26 face
27 base surface
28 weld seam
29 collar
30 weld seam
31 annular groove

The invention claimed is:

1. A spark plug for a gas-powered internal combustion engine, comprising:

a spark plug body with a passage in which an insulator is located;

a front end and a back end, wherein the insulator projects from the spark plug body at the back end and has a supply terminal there;

a center electrode that projects from the insulator at the front end and is connected in an electrically conductive manner to the supply terminal through a center conductor located in the insulator;

a ground electrode support that is attached to the spark plug body and supports at least one ground electrode that forms a spark gap together with the center electrode;

a swirl chamber located at the front end of the spark plug whose wall surrounds the center electrode and the ground electrode;

the wall of the swirl chamber is formed by a cylindrical sleeve, which has an open front face and radial perforations;

the ground electrode support includes an annular base part and at least one arm that supports the ground electrode; and the arm starts at the base part and extends within the swirl chamber in the longitudinal direction of the spark plug;

wherein the arm of the ground electrode support increases in cross-section starting from the ground electrode it supports toward the annular base part of the ground electrode support.

2. The spark plug according to claim 1, wherein a gap is present between the arm of the ground electrode support and the wall of the swirl chamber, and the gap becomes smaller in a direction running from the front end of the spark plug to the back end of the spark plug.

3. The spark plug according to claim 1, wherein the spark plug body has a flat face on the front end, and a flat base surface of the annular base part of the ground electrode support rests against the flat face.

4. The spark plug according to claim 1, wherein the ground electrode support is welded to the spark plug body.

5. The spark plug according to claim 1, wherein the ground electrode support holds the sleeve forming the wall of the swirl chamber.

6. The spark plug according to claim 5, wherein the ground electrode support has a circumferentially arranged annular collar that is concentric to the annular base part, and has an annular groove that is located between the collar and the arm.

7. The spark plug according to claim 6, wherein the sleeve forming the wall of the swirl chamber is attached to the collar of the ground electrode support.

8. The spark plug according to claim 6, wherein the annular groove has a rounded groove bottom.

9. The spark plug according to claim 1, wherein the center electrode has at its front end a precious metal ring.

10. The spark plug according to claim 1, wherein at least one of the perforations in the sleeve that forms the wall of the swirl chamber is positioned such that the arm of the ground electrode support is accessible in the radial direction through the at least one perforation.

11. The spark plug according to claim 1, wherein the ground electrode support includes at least two arms.

12. The spark plug according to claim 11, wherein the at least one ground electrode includes multiple ground electrodes, wherein each of the arms supports one of the ground electrodes.

13. The spark plug according to claim 11, wherein the at least one ground electrode is an annular ground electrode that surrounds the center electrode and is supported by at least two arms.

* * * * *